US007920052B2

(12) United States Patent
Costabile

(10) Patent No.: US 7,920,052 B2
(45) Date of Patent: Apr. 5, 2011

(54) SPORTS MONITORING AND TRACKING SYSTEM

(76) Inventor: Michael Joseph Costabile, Bolivia, NC (US)

( * ) Notice: Subject to any disclaimer, the term of this patent is extended or adjusted under 35 U.S.C. 154(b) by 398 days.

(21) Appl. No.: 12/286,999

(22) Filed: Oct. 3, 2008

(65) Prior Publication Data

US 2010/0085167 A1 Apr. 8, 2010

(51) Int. Cl.
*A63B 69/00* (2006.01)

(52) U.S. Cl. ..... 340/323 R

(58) Field of Classification Search ..... 340/323 R, 340/539.11, 309.16, 691.6; 368/3
See application file for complete search history.

(56) References Cited

U.S. PATENT DOCUMENTS 5,293,354 A * 3/1994 Costabile ..... 368/11
6,369,697 B1 * 4/2002 Poole ..... 340/573.1
6,603,711 B2 * 8/2003 Calace ..... 368/109
7,218,216 B1 * 5/2007 Uehran ..... 340/517

* cited by examiner

*Primary Examiner* — Phung Nguyen
(74) *Attorney, Agent, or Firm* — Irving M. Freedman

(57) ABSTRACT

A sports monitoring and timing system utilizing remotely actuated game clock controls with coded identification carried by a plurality of officials and a signal processor to combine the control signals with timing signals to generate a record of each starting and stopping of the game clock along with the identity of the initiator and the control equipment initiating the action, to record the time of each goal, and to preserve and transmit the record to others for quality review purposes. The system includes a security code to prevent unauthorized actuation of the game clock, and remote battery monitoring.

19 Claims, 4 Drawing Sheets

SPORTS MONITORING AND TRACKING SYSTEM

BACKGROUND OF INVENTION

This invention relates to a monitoring and tracking system for use with a sports timing system such as the digital clock utilized in basketball games.

In many sports, such as basketball, the contest is divided into specific time periods or durations of play which requires accurate timing. The play periods are frequently interrupted for time outs for official or television commercial reasons, the limited number of time outs allocated to each team, and for fouls called by the officials. Such fouls or actions requiring penalties must be assessed to the player committing the foul, and play is stopped to allow, for example, any applicable free throws resulting from the foul. In addition, officials may stop play for a wet floor or an injured player.

As a result, the official time clock is frequently started and stopped upon such actions of any of the officials or the timekeeper. The officials signal the stop and start of play by whistles and the corresponding starting and stopping of the official time clock may be accomplished by the timekeeper pressing a button, or accomplished remotely and automatically by the officials' whistles using equipment such as shown in my U.S. Pat. No. 5,293,354, issued Mar. 8, 1994.

However, problems may be encountered when there is an inadvertent blowing of the whistle by an official who may be reluctant to own up to the error, or even by a spectator, or inadvertent pressing of the start/stop button by the timekeeper, and in identifying which official blew his whistle when there are multiple whistles blown. When calls by officials are in question, exact timing becomes important. Sports associations such as the Basketball Operations of the National Basketball Association (NBA) and NBA and college team offices routinely review videotapes of all games in their quality and accuracy review of the calls by the officials, and to insure and preserve the integrity of the game. Officials do make mistakes which can affect which team wins a particular game. When officials are later determined to have made a serious error, particularly one affecting the outcome of a game, they may be punished such as by suspension for a specified period. The potential of after-game detection and punishment of officiating error encourages diligence and correct performance by officials. Moreover, because of potential bias or other improprieties, it is important that official calls be scrutinized, even after a game is completed.

Since officials frequently signal a game stopping event such as a foul by three or four quick whistle blasts, the blasts of two officials may be simultaneous or overlapping. An analysis for quality control review of the event is helped by the precise recording of the whistle blasts or officials involved and specific sequence of events.

Television replays are not designed to present an accurate review of the actions of officials and do not identify who blew a whistle first in the case of multiple whistles. Moreover, if television playback is slowed down to closely examine a play, the whistle blasts frequently becomes inaudible.

It is also desirable that the electronic equipment, called a beltpack, worn by each official in a remotely actuable sports timing system be identified for quality control checking of the overall timing system and the equipment involved, including the battery strength of the beltpack.

As a result, it is highly desirous to have a record of each starting and stopping of play along with the identity of the initator and equipment initiating such action, to be able to display such information during the game, and to preserve and transmit such information to associations and others either during or after the game.

In addition, security of the remotely actuable system becomes of great importance to prevent inadvertent actuation by sources other than the officials.

SUMMARY OF THE INVENTION

Thus, there is a particular need for a secure remotely operated sports monitoring and tracking system which provides a record of which official initiated what action, at what time.

In accordance with one form of the invention, a sporting event game timing clock is provided with remotely actuable game clock signals generated by each of the floor officials or by the timekeeper. Each signal is provided with an identification code to enable the system to distinguish which official initiated the game action, be it stopping play or starting play.

A signal processor is provided to generate, display and store a record of each starting and stopping of play along with the identity of the official by name, and the identification of the specific equipment utilized by that official. A visual display is produced at the official timekeeper's position base station with all times provided digitally in one tenth of a second increments. The system includes a digital clock, preferably the official game clock, to the extent it includes digital access, to synchronize the recorded timing with the official game clock.

A sensor is positioned at each goal, namely a hoop switch in the case of basketball, to accurately detect the instant the game ball passes through the goal to enable the display and recording of the time of the goal. This is particularly important in turning off the shot clock near the end of the game to accurately indicate the precise time remaining in the game.

The record of the exact time of each start and stop of play, along with the identity of the official initiating the event is displayed and stored at the base station, and on a removable USB stick. Internet connections are provided enabling direct transmission of the game record to a supervisory organization such as the National Basketball Association (NBA) or team offices for quality review of the actions of the officials.

Connections may be made to one or more of the video cameras tracking the game to provide an associated visual record in which the actions of the various identified officials can be combined to simultaneously display video, timing and identification information.

The base station includes both visual, digital and a blinking light to demand the attention of the official timekeeper to game events such as stopping and starting play and the end of the game.

DESCRIPTION OF INVENTION

Figure 1:
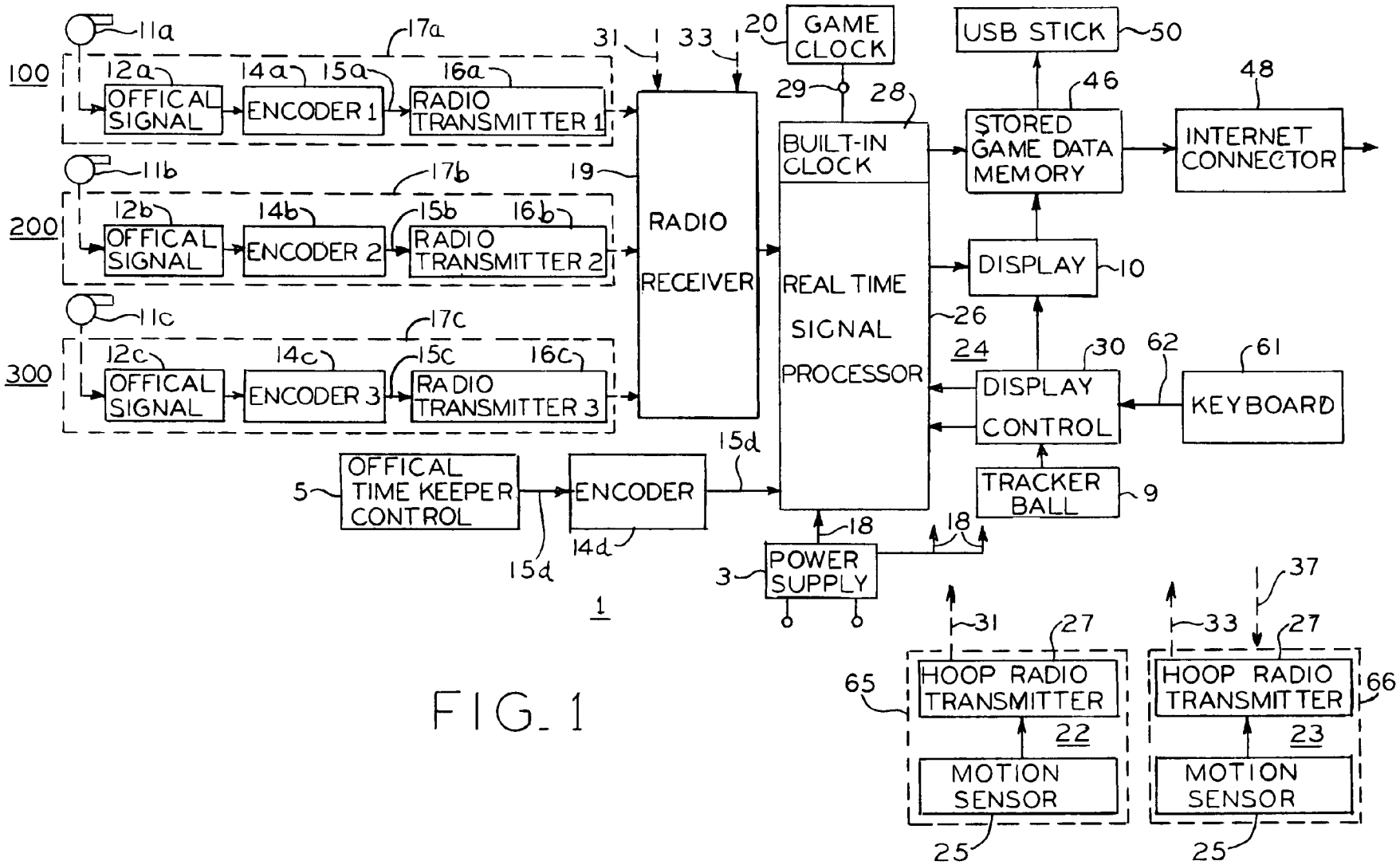
FIG. 1 is a block diagram of a sports monitoring and tracking system incorporating the present invention.

Referring first to FIG. 1. Sports monitoring and tracking system 1 provides a time record of the actions of each of the officials at the sports event, which is illustrated as applicable to a basketball game with three officials 100, 200 and 300 on the basketball court and an official timekeeper. It is believed helpful to describe monitoring and tracking system 1 in the context of a specific sport although it is applicable to other sports in which play is repeatedly stopped and started by multiple officials such as, for example, soccer.

Each of the officials 100, 200 and 300 respectively on the basketball court can by blowing official whistle 11*a*, 11*b* and 11*c*, respectively, generate official signal 12*a*, 12*b* and 12*c* respectively to remotely stop game clock 20. This may conveniently be accomplished in the manner shown in my aforesaid U.S. Pat. No. 5,293,354. Official signal 12*a*, 12*b* and 12*c*, respectively, after being encoded by encoder 14*a*, 14*b* and 14*c* respectively, are transmitted by radio transmitters 16*a*, 16*b* and 16*c*, respectively to provide clock timing control signals 15*a*, 15*b* and 15*c* respectively to real time signal processor 26 of base station 24 by way of radio receiver 19. Signal generators 17*a*, 17*b* and 17*c*, respectively, are portable and adapted to be carried in a belt pack (not shown) attached to the belts of the officials.

Figure 2:
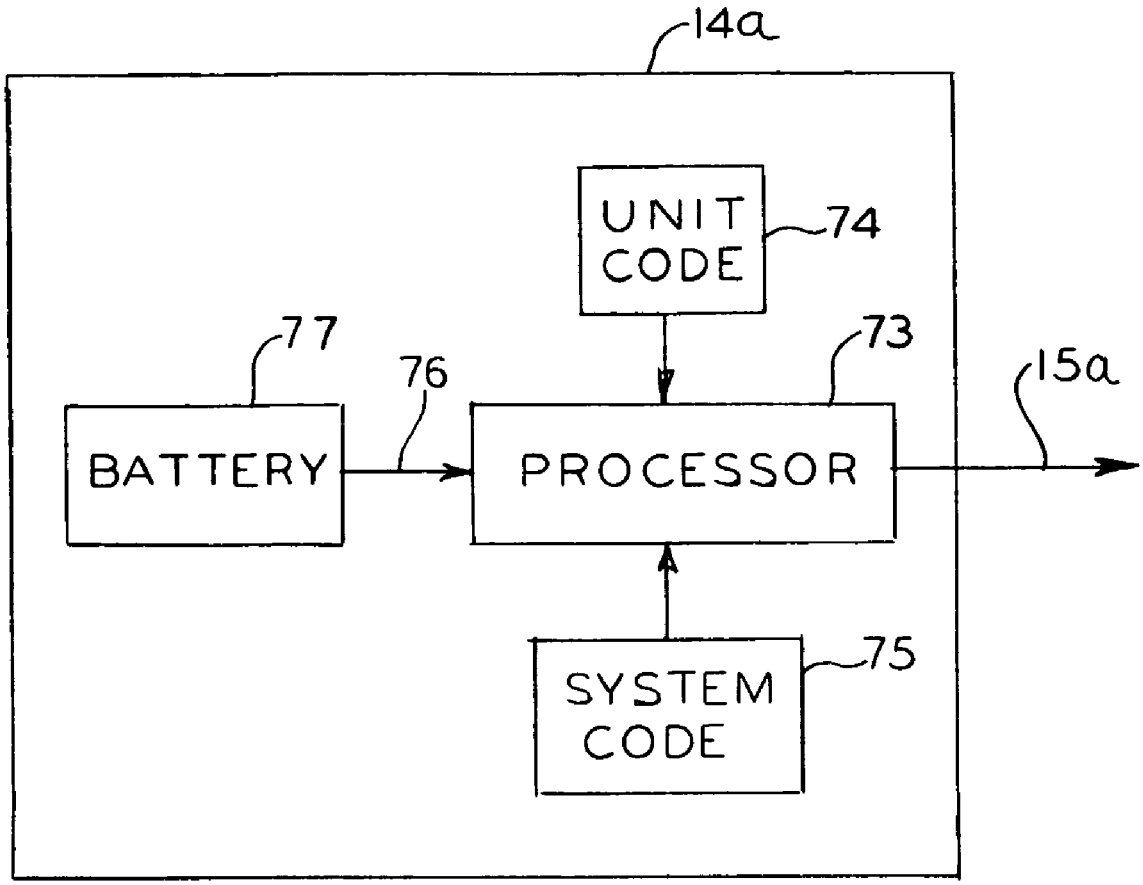
FIG. 2 is a block diagram showing details of a portion of FIG. 1.

Referring next to FIG. 2 in addition to FIG. 1. FIG. 2 shows details of encoders 14*a*, 14*b*, 14*c* and 14*d* with encoder 14*a* being shown by way of example. Processor 73 receives input signals from System Code 75, Unit Code 74 and battery 77 (via battery voltage signal 76). System Code 75 verifies that signal generator 17*a* is part of the same system or sports team as the other signal generators providing inputs to signal processor 26. Sports monitoring and tracking system 1 is made responsive only to those control signals with the proper system code and will not respond to false signals. False signals could be provided by electronic equipment of another team or another sports monitoring and tracking system, spurious electronic signals from a spectator's electronic equipment or from other sources. Whatever the possible source of interfering signals, sports monitoring and tracking system 1 is made responsive to only signals including system code 75 to ensure security and the integrity of the tracking system and the game. System code 75 can be changed from time to time to further enhance system security.

Unit code 74 identifies the particular signal generator or belt pack 17*a*, 17*b* and 17*c* and official timekeeper control 5 initiating control signal 15*a*, 15*b*, 15*c* and 15*d*, respectively, to provide the identity of the official initiating the control signal and to aid in maintenance and repair of the units. Battery voltage signal 76 is provided as part of a built-in battery test or checking system to enable detection and replacement of weak batteries to avoid erratic, or failure of, control signals 15*a*, 15*b* and 15*c*, respectively.

Official Timekeeper Control 5 is connected to real time signal processor 26 through encoder 14*d* which identifies the timekeeper unit code 74 and system code 75 in the manner described above for encoders 14*a*, 14*b* and 14*c*. A battery voltage signal is not required since base station 24 is not a portable battery operated unit. Official timekeeper control 5 enables the timekeeper to start and stop game clock 20 and to perform other game functions as discussed below in connection with display unit 10 and FIG. 3.

Base station 24 positioned for use by the official timekeeper encompasses all of the FIG. 1 equipment less official whistles 11*a*, 11*b* and 11*c*; signal generators 17*a*, 17*b* and 17*c*; basketball hoops 65 and 66 with associated equipment, and game clock 20. Base station 24 includes built-in digital game clock 28 which is available in the event that a digital signal connection 29 to game clock 20 is not available at the sports event facility. Power supply 3 provides power indicated by arrows 18 to base station 24.

Hoop switches 22 and 23, respectively, each include motion sensor 25 and hoop radio transmitter 27 and are positionable within or adjacent to goals such as basketball hoops 65 and 66, respectively, to provide goal signals 31 and 33 to radio receiver 19 to enable essentially instantaneous signals when an object such as a basketball indicated by arrow 37 passes through the basketball hoop. Hoop switches 22 and 23 are positioned low adjacent basketball hoops 65 and 67 such that if a spinning basketball 37 goes in a basketball hoop "rattles" around, and then bounces out without passing completely through the basketball hoop, motion sensor 25 will not be actuated. One or more hoop switches 22 and 23 could be used for goals on other timed games such as soccer.

Signal processor 26 thus receives a plurality of signals—official signal 12*a*, 12*b* and 12*c*; system code 75; unit code 74; battery voltage 76; official timekeeper control 5 and hoop switch signals 31 and 33. These signals are combined with a clock or time signal from Game clock 20 or built-in clock 28 to provide game control signals which include who, what and when information which is displayed on display 10 as discussed below in connection with FIG. 3, and stored or transferred to remote locations by way of internet connector 48 as discussed below and in connection with FIG. 4.

Figure 3:
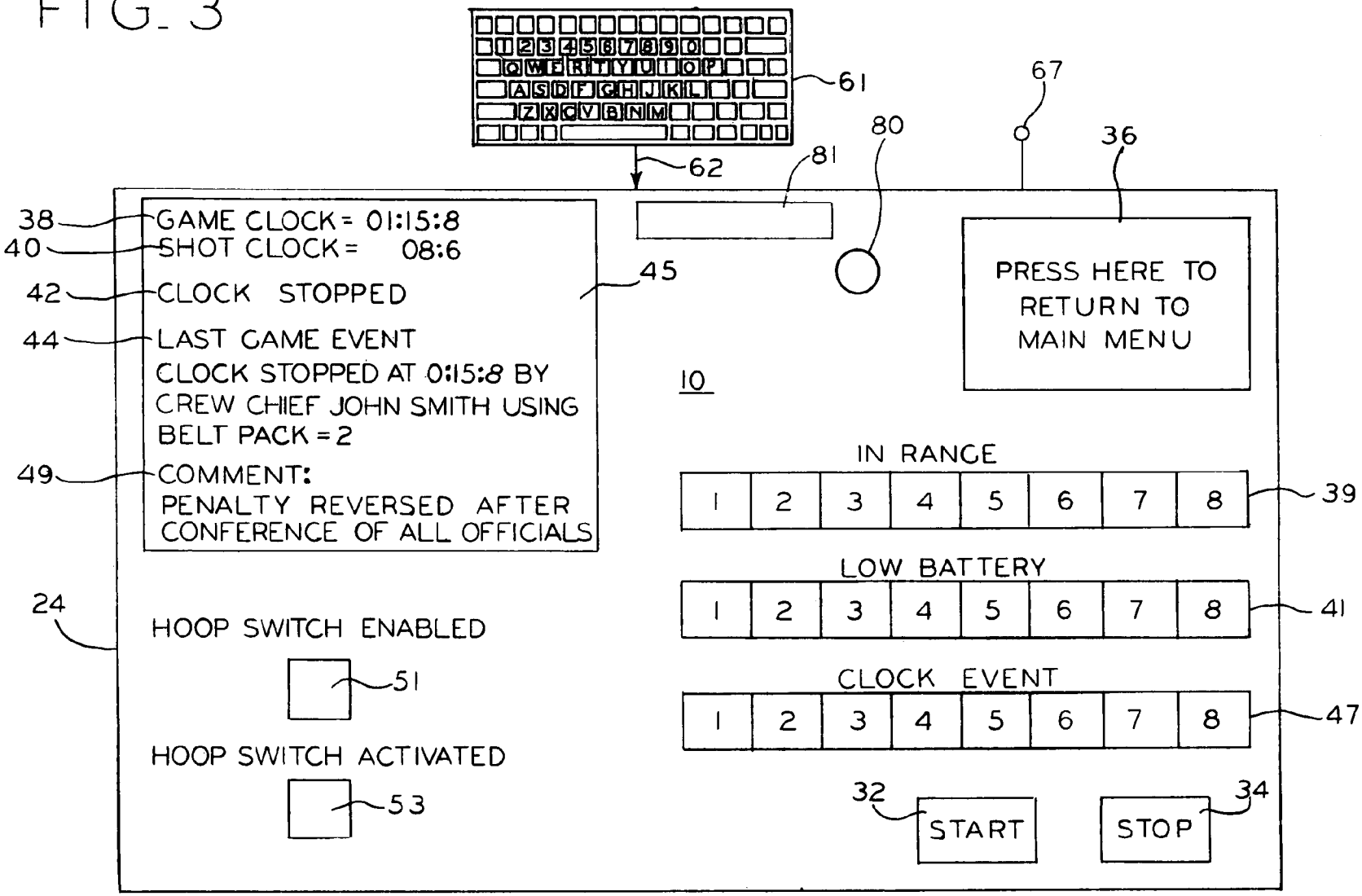
FIG. 3 shows a sample game play screen illustrating the types of data stored and displayed by the subject sports monitoring and tracking system.

Stored game data memory 46 which may be part of signal processor 26 stores the time of every actuation of game clock 20 along with the identification of the official who actuated the game clock and the applicable signal generator 17*a*, 17*b* and 17*c*, respectively, worn by the official on the floor; or in the case of the official timekeeper, actuation of start button 32 or stop button 34 of base station 24 (see FIG. 3). Base station 24 also includes power supply 3, display 10, internet connector 48 and detachable USB stick 50. USB stick 50 provides a physical, detachable and moveable memory which can be removed and stored as a record of the game or provided to another facility such as an association, conference or team office. Power supply 3 includes a battery back-up (not shown).

Referring next to FIG. 3 in addition to FIG. 1. FIG. 3 shows a sample game play screen of display 10 positioned in front of the official timekeeper during game play, to provide relevant information. Display 10 is a touch screen display such that start button 32 and stop button 34 visually appear as "buttons" which are touched by the official timekeeper to start and stop game clock 20. A large touch button 36 identified as "Press Here To Return To Main Menu" is provided for setting up the equipment prior to the game, and to provide controls to send stored game information to remote sites as discussed below. In range indicator 39 indicates when radio transmitters 16*a*, 16*b*, 16*c* and others in the system (including spares) provide adequate strength signals to radio receiver 19 for dependable use. Low battery indicator 41 maintains a constant check on battery 71 (see FIG. 2) in each signal generator such as 17*a*, 17*b* and 17*c* to enable timely battery replacement. Clock event indicator 47 indicates the beltpack and hence official initiating the game event being displayed as discussed in more detail below. Hoop switch enabled indicator 51 and hoop switch activated indicator 53 indicate the status of basketball hoop switches 22 and 23.

Display 10 also includes game data screen 45 which displays current game information including game clock indicator 38 indicating the amount of time remaining for the game period, and shot clock indicator 40 indicating the amount of time in which the team possessing the ball must shoot and at least hit the rim of the basket or turn the ball over. Data screen 45 also includes clock status indicator 42 which indicates whether the game clock is running or is stopped, and last game event indicator 44 which keeps the official timekeeper updated and aware of the last event which in the example shown, the clock was stopped at 01:15:8 by crew chief John Smith, using belt pack number 2. This type of information indicating who did what and when is extremely valuable in reviewing the actions of the officials during and after the game and can be used in combination with video recordings to evaluate such actions in ensuring the integrity of the game. Comment 49 has been entered through keyboard 61 to indicate that the penalty which was initially imposed was reversed after a conference of all officials.

Keyboard 61 (only a portion of the keys being shown) along with menu access button 36 is used to enter the desired game information on display 10 and may be a conventional computer keyboard or may be built in and selectively displayed on the display as a touch pad display. It is also used by the official timekeeper to enter data such as comment 49. Menu Access Touch Button 36 provides access to each unit code 74 signal which identifies the signal generator 17*a*, 17*b* or 17*c*, respectively, or official timekeeper control 5 generating a signal to which the desired individual identification is added through keyboard 61. The desired identification may be the individual's name and title such as official timekeeper, Crew Chief or official on the floor. This information is displayed and placed in memory to be combined with the time signal provided by game clock 20 or built in clock 25 and each control signal 15*a*, 15*b*, 15*c* and 15*d*, respectively. The record of who did what, when is thus made available during and after the game.

Game data such as that displayed by game data screen 45 and that included in stored game data memory 46 thus includes the name of floor official 100, 200 and 300 or the official timekeeper along with the exact time and nature of each of their control actions.

The signals from one or more video cameras (not shown) may be connected to video camera connector 67 to be added to stored game data memory 46 to add video images of the game. Display 10 includes audible signal 80 and visual signal 81 to alert the official timekeeper of each remote control action by officials 100, 200 and 300. Visual signal 81 and clock event indicator 47 include LED or light emitting diode bars which can turn red or green. When an official 100, 200 or 300, respectively, blows whistle 11*a*, 11*b* or 11*c*, respectively, to start game clock 20, the LED bar of visual signal 81 flashes bright green for three times while audio signal 80 sounds three beeps to alert the official timekeeper to the change in game status. Visual signal 81 then remains green at a lower light level to remind the official timekeeper that game clock 20 is running. When whistle 11*a*, 11*b* or 11*c* is subsequently blown to stop game clock 20 the visual and audible signals are repeated with the LED bar of visual signal 81 displaying two levels of red instead of green which remains red until game clock 20 is again started. A similar sequence of signals are provided on actuation of official timekeeper control 5.

At the same time that visual signal 81 and audio signal 80 are activated, clock event indicator 47 is actuated to illuminate numerals 1, 2, 3, etc. to identify which beltpack and hence which official initiated the event. The illumination of clock event indicator 47 like that of visual signal 81 is green when the event is starting game clock 20 and red when stopping the game clock.

Game data screen 45 also provides more detailed information and comments on game status as discussed above.

For sporting events other than basketball there may be more than three officials on the floor, field or playing area. Display 10 is for a system with eight signal generators such as 17*a*, 17*b* and 17*c* as evidenced by the eight identifiers on in range indicator 39, low battery indicator 41 and clock event indicator 47. This provides for spare signal generator channels and an increase in the number of officials beyond the three floor officials in the basketball example discussed above.

Tracker ball or mouse 9 is used in the conventional manner to select the desired menu item, or in entering data such as comment 49.

All timing information is provided in tenths of a second. Such precise timing information is extremely useful to the officials at the sporting event, and to those other officials who may remotely and/or subsequently review the game and actions of the game officials. In a basketball game it is only the final one minute of play in each period that tenths of a second are provided.

Menu access button 36 can also be used to display information in stored game data memory 46 on game data screen 45. For example, all of the foul or penalty calls of a single official in the game can be displayed to review whether that official favored one team in imposing penalties. This is, of course, only one consideration in insuring the integrity of the game by alerting association officials to any possible favoritism in close or disputed calls.

Keyboard 61 is also used for game set-up. The game set-up may, for example, include the insertion of the name of official 100, 200 and 300, and the identity of the belt pack or signal generator 17*a*, 17 or 17*c* carried by that official. Keyboard 61 can also be used to insert comments by the official timekeeper to be viewed later when the game calls are being reviewed. Comment 49 which indicates that the penalty was reversed after conference of all officials could also, for example, indicate that the official whistle 11*a*, 11*b* or 11*c* was sounded after the timekeeper's horn was sounded to signal a time clock violation.

Figure 4:
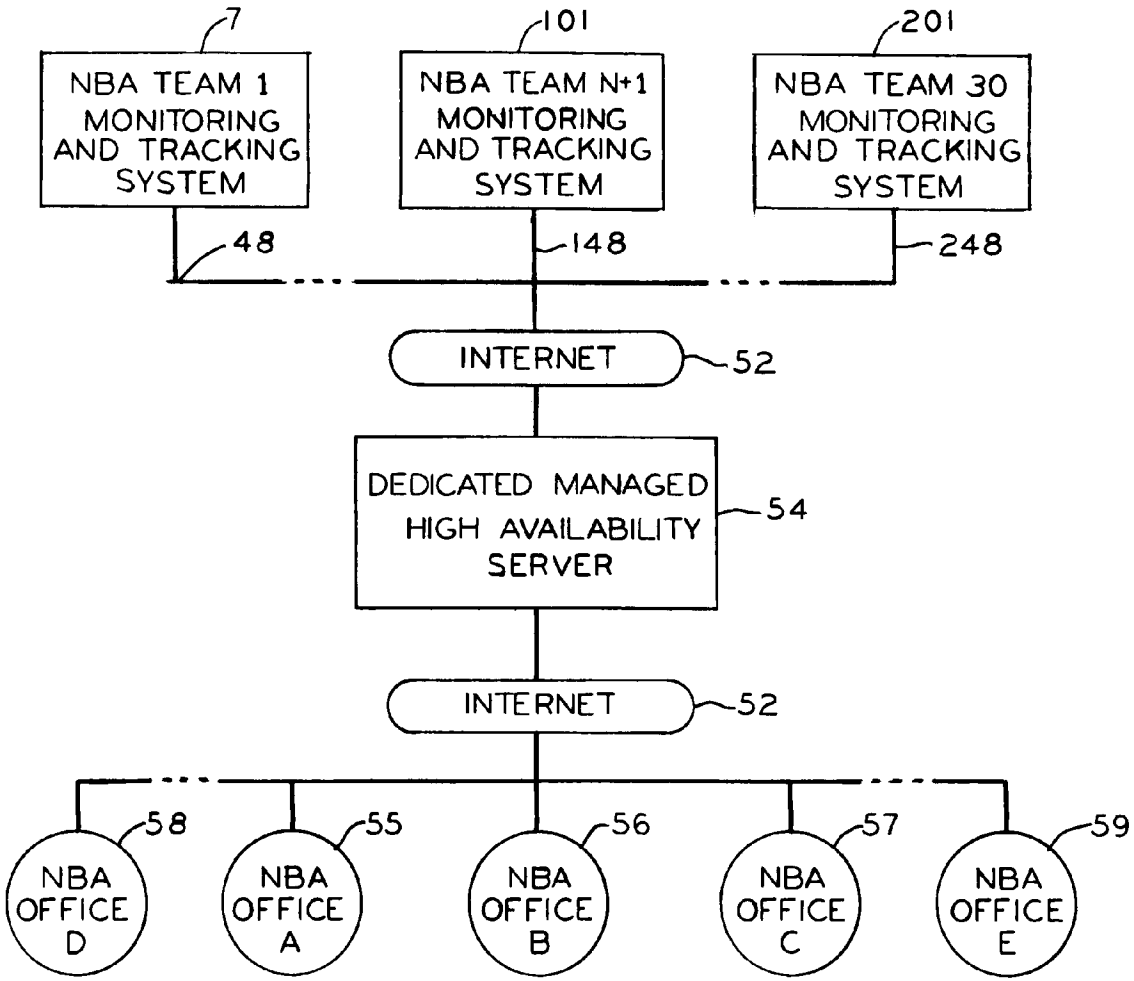
FIG. 4 is a block diagram of the internet connections between the system and a plurality of team and association offices.

Referring next to FIG. 4. FIG. 4 is a block diagram showing the internet connections for transmitting game information to the National Basketball Association (NBA). The NBA is shown as an example, although the internet connection could be to any sports association or conference. NBA team 1 monitoring and tracking system 7 is connected to internet 52, as is NBA Team N+1 monitoring and tracking system 101 and others teams up to NBA Team 30 monitoring and tracking system 201. Internet connections 48, 148 and 248, respectively, direct game monitoring and tracking systems information from various games played by the NBA teams through dedicated managed high availability server 54 to the various NBA offices, namely NBA office A 55, NBA office B 56, NBA office C 57, NBA office D 58 and NBA office E 59. The various offices are the team offices and the central office, and the information can be fed live during the game, or provided later.

While the present invention has been described with respect to certain preferred embodiments thereof, it is to be understood that numerous variations in the details of construction, the arrangement and combination of parts, and the type of materials used may be made without departing from the spirit and scope of the invention.

What is claimed is:

1. A sports event monitoring and tracking system comprising:

a plurality of signal generators at least some of which are adapted to be carried by a plurality of officials;

each of said signal generators providing an individually identifiable control signal;

a timer to provide timing signals for said sports event;

said individually identifiable control signals controlling the time of play of said sports event provided by said timer; and a signal processor to combine said individually identifiable control signals with said timing signals to generate a time record of the initiation each of said individually identifiable control signals;

said time record identifying the initiator and time of each initiation of said individually identifiable control signal.

2. The sports event monitoring and tracking system of claim 1 in which said timer is the official game clock, and said official game clock is connected to said monitoring and tracking system to enable said time record of each of said individually identifiable control signals to correspond to the time provided by said official game clock.

3. The sports event monitoring and tracking system of claim 2 for use in a basketball game including a shot clock wherein said individually identifiable control signals start and stop said game clock, and said event monitoring and tracking system indicates and records the stopping and starting of said shot clock in addition to said game clock.

4. The sports event monitoring and tracking system of claim 3 wherein said individually identifiable control signals are used to provide the identity of the person initiating the control signal.

5. The sports event monitoring and tracking system of claim 4 including internet access and internet connections enabling said time record of said monitoring and tracking system to be transmitted directly to at least one remote basketball association office location.

6. The sports event monitoring and tracking system of claim 5 wherein said internet connection includes a dedicated high availability server.

7. The sports event monitoring and tracking system of claim 3 including one or more motion sensor and radio transmitter combinations adapted to be positioned adjacent a goal to transmit a goal signal to said system to when a ball passes said motion sensor.

8. The sports event monitoring and tracking system of claim 7 wherein said goal signal is utilized to stop said game clock and to display and record the time of each said goal signal.

9. The sports event monitoring and tracking system of claim 8 wherein said system is for use in a basketball game including two basketball hoops and said motion sensors are positionable adjacent a lower portion of said basketball hoops.

10. The sports event monitoring and tracking system of claim 3 wherein said signal generators are adapted to be carried in packs worn by a plurality of officials of said sports event, with each said signal generator being provided with a unit code to enable identification of the official wearing said signal generator.

11. The sports event monitoring and tracking system of claim 2 including at least one signal to alert the official timekeeper to a change in the status of said sports event, and an indication of which of said signal generators caused said change in said status.

12. The sports event monitoring and tracking system of claim 11 in which each said signal generator includes a battery and said individually identifiable control signal from said signal generator includes battery voltage information to enable said signal processor to remotely display the battery voltage level of each said signal generator to enable timely replacement of weak batteries.

13. The sports event monitoring and tracking system of claim 11 including a removable memory to provide a physical and transportable time record.

14. The sports event monitoring and tracking system of claim 13 including a built-in clock available to substitute for said timer.

15. A sports event monitoring and tracking system comprising:

a plurality of signal generators at least some of which are adapted to be carried by a plurality of officials;

each of said signal generators providing an individually identifiable control signal;

a timer to provide timing signals for said sports event;

said individually identifiable control signals controlling the time of play of said sports event;

a signal processor to combine said individually identifiable control signals with said timing signals to generate a time record of the initiation each of said individually identifiable control signals;

said time record identifying the initiator and time of each initiation of said individually identifiable control signal; and control of said time of play being responsive to only signals from a designated plurality of said signal generators to provide security to said system from other signals.

16. The sports event monitoring and tracking system of claim 15 in which said signal processor and said designated plurality of said signal generators produce a system code to which the system is responsive providing a secure system wherein signal generators from another sports monitoring and tracking system can not control said system.

17. The sports event monitoring and tracking system of claim 16 in which said system code can be changed.

18. The sports event monitoring and tracking system of claim 17 in which said signal generators provide a unit signal to identify the unit providing the signal.

19. The sports event monitoring and tracking system of claim 18 in which a connection is provided for video camera signals to be added to the information provided by said system.

* * * * *